US008456383B2

(12) United States Patent
Chevroulet et al.

(10) Patent No.: US 8,456,383 B2
(45) Date of Patent: Jun. 4, 2013

(54) CIRCUIT AND METHOD FOR CONTROLLING A LIQUID CRYSTAL SEGMENT DISPLAY

(75) Inventors: Michel Chevroulet, Neuchatel (CH); Gregoire Guye, Chezard (CH)

(73) Assignee: Semtech International AG, Wil (CH)

( * ) Notice: Subject to any disclaimer, the term of this patent is extended or adjusted under 35 U.S.C. 154(b) by 680 days.

(21) Appl. No.: 11/912,110

(22) PCT Filed: Apr. 27, 2005

(86) PCT No.: PCT/EP2005/051906

§ 371 (c)(1), (2), (4) Date: May 27, 2008

(87) PCT Pub. No.: WO2006/114132

PCT Pub. Date: Nov. 2, 2006

(65) Prior Publication Data

US 2009/0115710 A1 May 7, 2009

(51) Int. Cl.
*G09G 3/18* (2006.01)

(52) U.S. Cl.
USPC ..... 345/52; 345/34; 345/38; 345/50; 345/87

(58) Field of Classification Search
USPC ..... 345/87–104, 34, 38, 50–54, 204–215
See application file for complete search history.

(56) References Cited

U.S. PATENT DOCUMENTS

| | | | | | |
|---|---|---|---|---|---|
| 4,496,219 | A * | 1/1985 | Altman | 345/51 |
| 5,130,703 | A * | 7/1992 | Fairbanks et al. | 345/94 |
| 5,805,127 | A * | 9/1998 | Sonnek | 345/95 |
| 5,847,686 | A * | 12/1998 | Mouri et al. | 345/94 |
| 5,870,409 | A * | 2/1999 | Yach et al. | 714/724 |
| 5,874,931 | A * | 2/1999 | Drake et al. | 345/51 |
| 5,982,211 | A * | 11/1999 | Ko | 327/202 |
| 6,031,510 | A * | 2/2000 | Drake et al. | 345/50 |
| 6,121,945 | A * | 9/2000 | Tanaka et al. | 345/94 |
| 6,225,992 | B1 * | 5/2001 | Hsu et al. | 345/211 |
| 6,483,497 | B1 * | 11/2002 | Iino et al. | 345/100 |
| 6,522,318 | B1 * | 2/2003 | Kumagawa et al. | 345/98 |
| 6,975,314 | B2 * | 12/2005 | Kashiyama | 345/212 |
| 7,002,531 | B2 * | 2/2006 | Koike | 345/3.1 |
| 7,388,565 | B2 * | 6/2008 | Khurana et al. | 345/87 |
| 2003/0080929 | A1 * | 5/2003 | Gulsen | 345/87 |
| 2004/0207532 | A1 * | 10/2004 | Smithson | 340/643 |
| 2005/0134530 | A1 * | 6/2005 | Khurana et al. | 345/50 |
| 2005/0140406 | A1 * | 6/2005 | Rizzo et al. | 327/143 |
| 2005/0200785 | A1 * | 9/2005 | Jones | 349/134 |

FOREIGN PATENT DOCUMENTS

JP 7253765 10/1995

OTHER PUBLICATIONS

LCD Triplex Drive with COP820CJ, National Semiconductor Corporation, 1999.*

AN8000.13 Application Note.pdf, Semtech, Feb. 1, 2006.*

Williams, "Practical 5-Level LCD Multiplexing" Cockroft International, Inc. pp. 1-8.

* cited by examiner

*Primary Examiner* — Dmitriy Bolotin

(74) *Attorney, Agent, or Firm* — Blank Rome LLP

(57) ABSTRACT

Circuit and method for controlling a liquid crystal segment (1) display wherein the shape of the control signals of the segments (e1, e2, b1, b2) is adapted according to a supply voltage (Vdd) so as to compensate at least partially the opacity variations caused by the supply voltage variations.

15 Claims, 5 Drawing Sheets

Vdd -
Vdd
Shifting down
Vdd
Shifting up
e1
e2
b1
b2
s1: e1-b1
s2: e1-b2
Vdd
0
ON
0,791 Vdd
OFF
0,354 Vdd
ON
0,633 Vdd
OFF
0,283 Vdd
ON
0,825 Vdd
OFF
0,447 Vdd

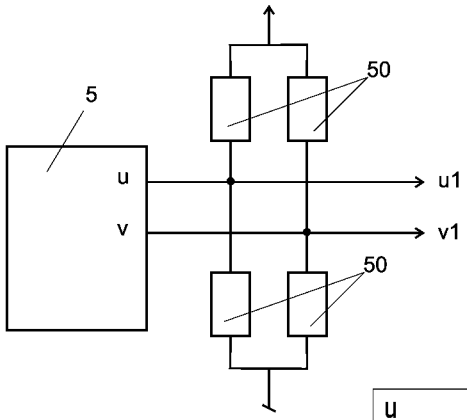
Fig. 7A
| u | v | b1 | b2 |
|---|---|---|---|
| 1 | HiZ | 1 | 0.5 |
| 0 | HiZ | 0 | 0.5 |
| HiZ | 1 | 0.5 | 1 |
| HiZ | 0 | 0.5 | 0 |
Fig. 7B
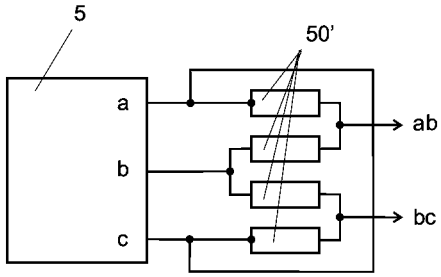
Fig. 8A
| u | v | w | b1 | b2 |
|---|---|---|---|---|
| 1 | 1 | 0 | 1 | 0.5 |
| 0 | 0 | 1 | 0 | 0.5 |
| 0 | 1 | 1 | 0.5 | 1 |
| 1 | 0 | 0 | 0.5 | 0 |
Fig. 8B

CIRCUIT AND METHOD FOR CONTROLLING A LIQUID CRYSTAL SEGMENT DISPLAY

The present application is a national phase of PCT/EP2005/051906 (WO 2006/114132), which is incorporated herein by reference.

TECHNICAL FIELD

The present invention concerns a method for controlling a liquid crystal segment display, wherein alternating voltage signals are applied to said segments so as to control their opacity.

STATE OF THE ART

FIG. 1 illustrates a circuit for controlling a liquid crystal segment display. The segment 1 has a front transparent electrode 11 and a back electrode, or backplane, 12, as well as a liquid crystal material 10 placed between the two electrodes. The crystals change orientation and modify the light polarisation when an electric voltage is applied between the electrodes 11 and 12. A polarising filter, not represented, placed at the surface of the segment, reveals the current polarisation state of the segment.

On FIG. 1A, the switch 3 is open and the voltage of the generator 2 is not applied to the electrodes 11, 12. The segment is then transparent. By closing the switch 3 in FIG. 1B, the material 10 changes polarisation and the segment becomes opaque.

Liquid crystal materials can be damaged by constant electric fields, so that the voltage applied between the segments' electrodes is preferably an alternating voltage, without continuous component.

Liquid crystal segments can be placed one next to the other so as to form different combinations of digits or letters by judiciously selecting the number of opaque respectively transparent segments.

Liquid crystal segments are often controlled in direct mode. In this case, it is frequent to use a single back electrode ("backplane") for several or for all the segments, and distinct front electrodes for each segment. A square amplitude signal Vdd is injected onto the common back electrode, and the same non-dephased signal is applied to the front electrodes of the transparent segments, or with a 180° phase-shift onto the front electrodes of the opaque segments. The resulting voltage between the electrodes is thus Vdd or 0 V. This control method however requires a control signal or pin for each segment, and additionally one pin for the back electrode. It is thus impossible to control segment displays of mean complexity directly with the exit leads of an ordinary microprocessor.

In order to increase the number of segments that can be controlled with the aid of a given number of pins, it has already been suggested in the prior art to time-multiplex the control signals applied to the segments. In the example of FIG. 2, the number of back electrodes (of backplanes) has been increased and has passed in this non-limiting example to two 120, 121. In this case, the signals b1, b2 applied to the back electrodes must have an inactive state when the signal e1 resp. e2 applied to the front electrodes is not intended for them.

FIG. 3A illustrates an example of square signal e2 applied to the front electrode 110 whilst the square signal e1 illustrated in FIG. 3B is applied to the other front electrode 111.

The signal b1, illustrated in FIG. 3C, is applied to the back electrode 120 whilst the signal b2 of FIG. 3D is applied to the other back electrode 121.

The segment s1 is controlled by the voltage between the front electrode 110 and the back electrode 120. The segment s2 is controlled by the voltage between the front electrode 110 and the back electrode 121. The segment s3 is controlled by the voltage between the front electrode 111 and the back electrode 120. Finally, the segment s4 is controlled by the voltage between the front electrode 111 and the back electrode 121.

As can be seen for example in FIGS. 3C and 3D, each cycle C1, C2 comprises a first phase i2 during which the back electrode b2 is inactive, i.e. supplied with an intermediary voltage, whilst a square active signal is applied to the back electrode b1. During the second phase i1, it is the electrode b11 that is inactive whilst the electrode b2 is controlled with an active signal.

The state of opacity of the electrodes is determined almost exclusively by the value applied to the corresponding front electrode during the phases i1 or i2 or the corresponding back electrode is active. FIG. 4A shows an example of signal allowing the inactive (transparent) state of a segment to be controlled by means of signals e resp. b on the front resp. back electrodes. FIG. 4B shows an example of signal allowing the active (opaque) state of a segment to be controlled by means of signals e resp. b on the front resp. back electrodes. In the examples of FIGS. 4A and 4B, the second phase I of the cycle c is inactive; the signal e during this phase is intended for segments connected to other back electrodes.

As can be seen on the last line of FIG. 4A, the mean voltage during a cycle applied to an inactive segment is not zero. In the same manner, the mean voltage during a cycle applied to an active segment is lower than Vdd, as can be seen on the last line of FIG. 4B. The contrast achieved by means of a multiplexed display control is thus lower than the contrast achieved by a direct control.

Simple mathematical computations make it possible to show that the mean voltage (RMS) applied to an active (opaque) segment is equal to 0.791·Vdd, whilst the voltage rms applied to a transparent segment equals 0.354·Vdd, Vdd being equal to the maximum amplitude of the signals e1, e2, b1 or b2. In the remainder of the text, Vdd is called "supply voltage".

If the supply voltage Vdd decreases, the mean voltage (on-rms) applied during one cycle to an active segment can find itself below the positive commutation threshold (on-threshold) of the liquid crystal material. In this case, a segment remains transparent instead of being opaque, or the contrast is seriously reduced.

Conversely, if Vdd is too high, the mean voltage (off-rms) applied during one cycle to an inactive segment can find itself above the positive commutation threshold (off-threshold) of the liquid crystal display. In this case, a segment is opaque instead of remaining transparent, or the contrast is seriously reduced. The situation is illustrated in FIG. 5.

The methods for liquid crystal segment displays, notably in the case of a multiplexed display, thus have the disadvantage of being sensitive to variations of the supply voltage Vdd. The display risks being wrong or in any case to lack contrast, in the case of a supply by a battery or by another source supplying a supply voltage too high or too low.

Circuits for regulating the control voltage of the LCD segment display have been proposed in the prior art in order to regulate the maximum supply voltage applied. Such regulators are however complex; achieving a continuous variable voltage is difficult to integrate in a digital circuit. Furthermore, the usual regulators only allow the supply voltage to be reduced when it is higher, but not increased when lower; these circuits are thus only adapted when a supply voltage much greater than the voltage required by the LCD segments is available.

BRIEF SUMMARY OF THE INVENTION

One aim of the present invention is notably to resolve this problem and to propose a device and a method for segment display free from the limitations of the prior art.

Another aim is to propose a device and a method allowing an LCD segment display circuit to be controlled directly with digital signals, with variable voltage levels requiring a voltage regulator.

According to the invention, this aim is notably achieved by means of a circuit and a method for controlling a liquid crystal segment display, wherein the shape of the segment control signals is adapted according to the supply voltage so as to compensate at least partially the opacity variations caused by the supply voltage variations.

This method has the advantage of compensating the opacity variation problems (lack of contrast or even wrong display) that can occur if Vdd varies, by adapting the shape of the signals applied to the electrodes. The shape of the signals Vdd applied is preferably adapted so as to compensate, at least partially, the variations of the mean voltage rms caused by the variations of the voltage Vdd.

This method has the advantage of compensating the variations of the mean voltage rms on one cycle by modifying the signals' cycle ratio, but without regulating the threshold levels of the binary or ternary logical signals applied.

In a preferred embodiment, the shape of the signals applied is modified only when the variation of Vdd exceeds a predetermined threshold. In another embodiment, more complex to implement, the shape of the signals applied varies in constant fashion according to the variations of Vdd.

In a preferred embodiment, when the supply voltage Vdd falls below a threshold, the shape of the signal is modified, for example by adding pulses, so as to increase the mean voltage applied during one cycle to a segment to make it opaque and/or to make it transparent.

Alternatively, or additionally, when the supply voltage Vdd exceeds a threshold, the shape of the signal is increased, for example by adding pulses, so as to reduce the mean voltage applied during one cycle to a segment to make it opaque and/or to make it transparent.

BRIEF DESCRIPTION OF THE DRAWINGS

Examples of embodiments of the invention are indicated in the description illustrated by the attached figures, where:

FIG. 7A illustrates an example of a circuit allowing the control signals of FIG. 6 to be generated from a microprocessor comprising at least some exits capable of being set to high impedance.

FIG. 7B is a table indicating the values of the signals b1 and b2 applied on the back electrodes for different values of the signals u, v at the exit of the microprocessor of FIG. 7A.

FIG. 8A illustrates a second example of circuit allowing the control signals if FIG. 6 to be generated from a microprocessor.

FIG. 8B is a table indicating the values of the signals b1 and b2 applied to the back electrodes for different values of the signals u, v at the exit of the microprocessor of FIG. 7A.

EXAMPLES OF EMBODIMENTS OF THE INVENTION

Figures 3A, 3B, 3C, 3D:
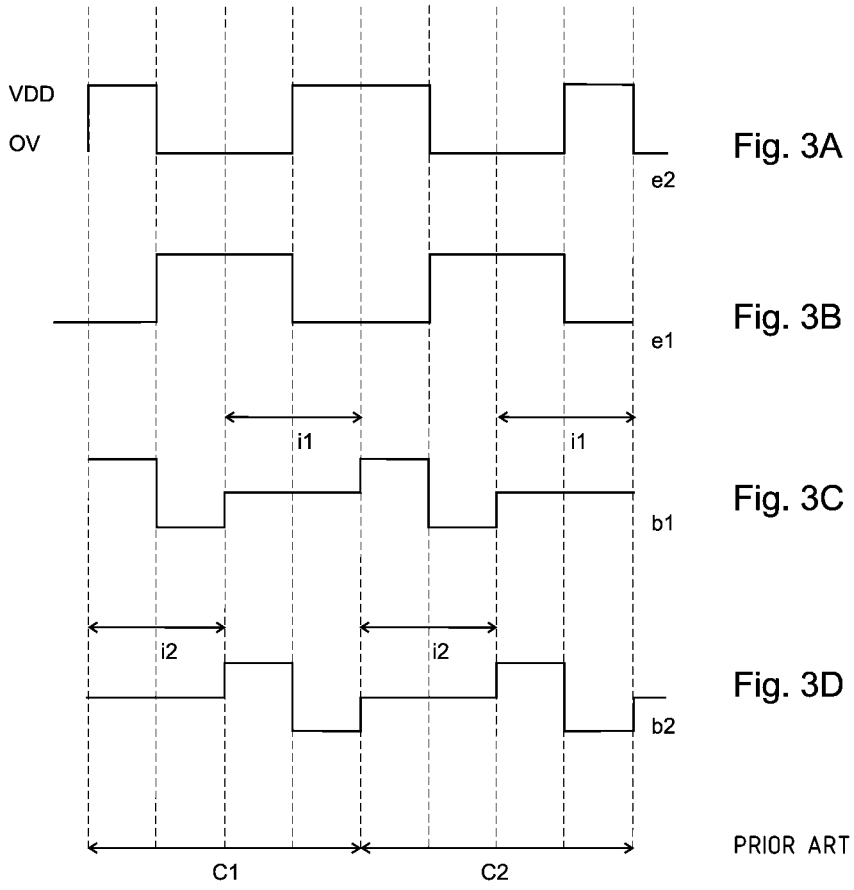
Fig. 3D PRIOR ART
FIG. 3, already discussed, illustrates control signals applied to the display of FIG. 2.
Figure 4A:
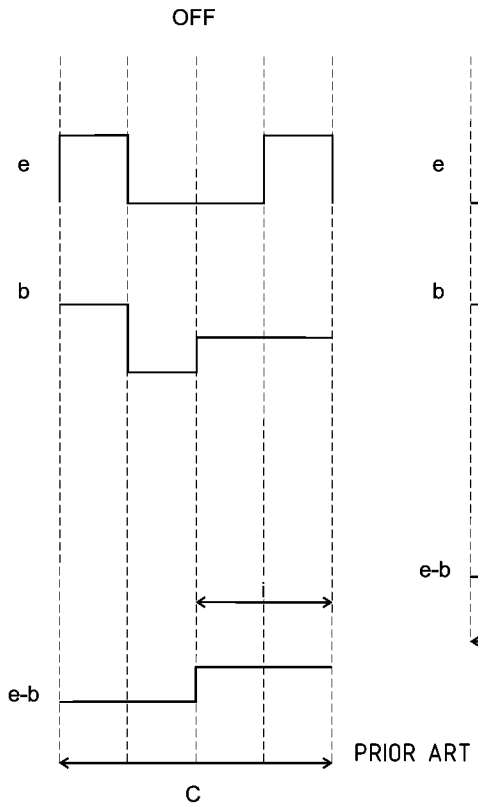
FIG. 4, already discussed, illustrates the voltages resulting on two segments of the display of FIG. 2.
Figure 4B:
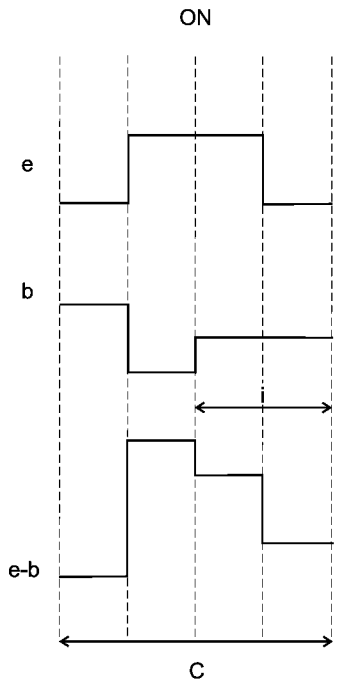
Fig. 4B PRIOR ART
Figure 5:
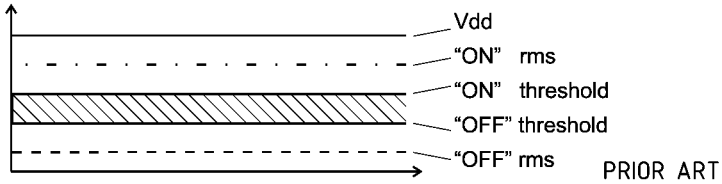
FIG. 5, already discussed, illustrates diagrammatically the relations between the rms-levels applied to the display segments and the commutation thresholds of the liquid crystal material.
Figures 6A, 6B, 6C, 6D, 6E, 6F, 6G, 6H, 6I, 6J, 6K, 6L, 6M, 6N, 6O, 6P, 6Q, 6R:
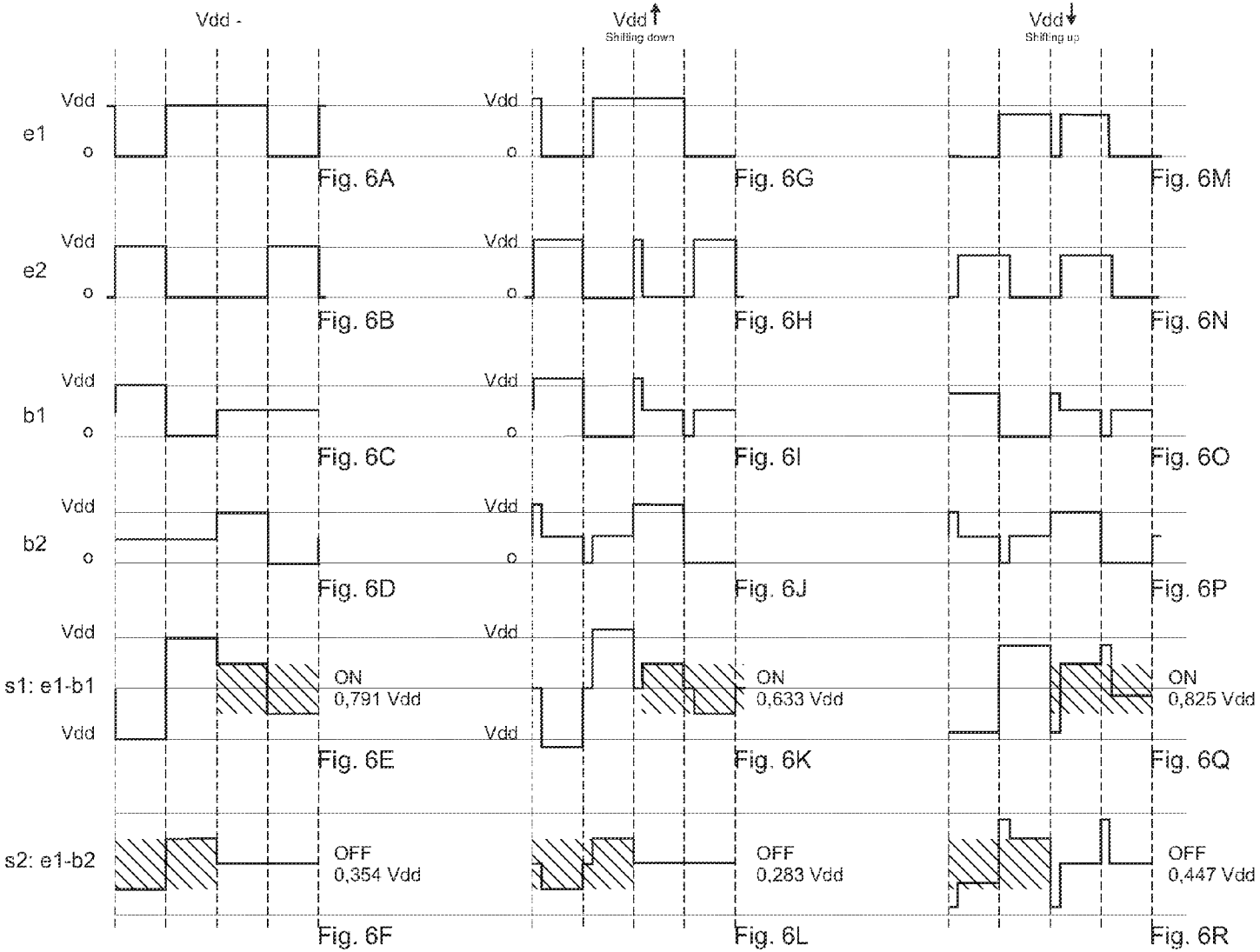
FIG. 6 illustrates examples of control signals that can be applied on the segments of a liquid crystal display according to the invention, as well as the resulting voltages on the segments.

With reference to FIG. 6, we will now describe the signals for controlling liquid crystal segment displays according to an embodiment of the invention. The first column, on the left, illustrates the signals applied when the supply voltage Vdd is normal, i.e. when this voltage is situated between two determined thresholds. In the illustrated example, the segments are controlled in this case by means of multiplexed signals as in the case of FIGS. 3 and 4 discussed above.

The middle column illustrates the modified signals that are applied when the supply voltage Vdd exceeds a first determined threshold. The modifications performed on the shape of the signals allow the increase of the mean voltage applied to the liquid crystal material caused by the increase of Vdd to be at least partially compensated.

The right column illustrates the modified signals that are applied when the supply voltage Vdd is below a second determined threshold. In this case, the signals applied are modified so as to increase the mean voltage applied for a given voltage.

Figure 1A:
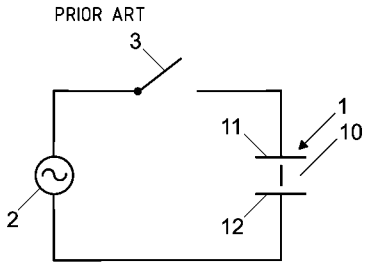
FIG. 1, already discussed, illustrates a diagram of a circuit for controlling a liquid crystal segment display.
Figure 1B:
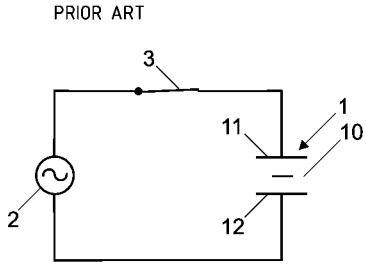
Figure 2:
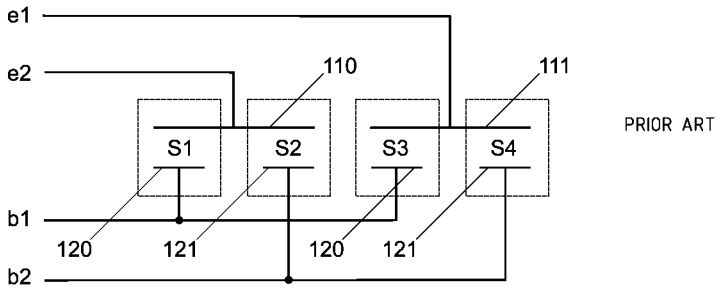
FIG. 2, already discussed, illustrates diagrammatically a display with 4 segments capable of being controlled in multiplexed manner.

The first line illustrates an example of signal e1 applied to a front electrode 110, corresponding in this case to two segments s1 and s2. In this example, the segment s1 is active (opaque) whilst the segment s2 is transparent. S1 corresponds to the back electrode b1 whilst s2 is controlled by the signal on the back electrode b2, in a manner conform to FIG. 2. s1 is controlled during the first phase of the cycle (b1 active) whilst s2 is controlled during the second part of the cycle (b2 active).

The fifth line illustrates the resulting voltage e1-b1 at the terminals of the active segment s1. As explained here above, the mean voltage rms applied during the length of the cycle equals 0.791·Vdd. If the voltage Vdd is too high, this mean voltage risks being too considerable and the liquid crystal material could be destroyed. On the other hand, if Vdd descends below a determined threshold, the mean voltage applied to the segment risks going below the on-threshold necessary to ensure a clean commutation of the segment and a sufficient contrast.

The sixth line illustrates the resulting voltage e1-b2 at the terminals of the inactive (transparent) segment s2. As explained here above, the mean rms voltage applied during the length of the cycle equals 0.354··Vdd. If the voltage Vdd is too high, this mean voltage risks exceeding the off-threshold so that the transparency of the segment is no longer guaranteed. On the other hand, if Vdd goes below a determined threshold, the contrast risks being unusually high.

The second column of FIG. 6 illustrates examples of signals that can be applied to the electrodes e1, e2, b1 and b2 when the supply voltage Vdd exceeds a determined threshold. In this case, the signals are modified so as to lower the mean voltage rms at least at the terminals of the inactive segments as well as, preferably, also at the terminals of the active segments. As can be seen in the figures, the modifications performed consist in adding further pulses onto the signals e1, e2, b1 and b2 so as to reduce the cycle ratio of the resulting voltage between the segments' terminals. More precisely, the pulses guarantee that the resulting signal at the terminals of the active (s1) and inactive (s2) segments is zero during the length of four additional pulses at each cycle. The mean voltage between the terminals of the active segment s1 is then 0.633·Vdd whilst the mean voltage at the terminals of the inactive segment s2 falls to 0.283·Vdd.

The third column of FIG. 6 illustrates examples of signals that can be applied to the electrodes e1, e2, b1 and b2 when the supply voltage Vdd goes below a determined threshold. In this case, the signals are modified so as to increase the mean voltage rms at least at the terminals of the active segments as well as, preferably, also at the terminals of the inactive segments. As can be seen in the figures, the modifications performed consist in adding further pulses onto the signals e1, e2, b1 and b2 so as to increase the cycle ratio of the resulting voltage between the segments' terminals More precisely, the pulses guarantee that the resulting signal at the terminals of the active (s1) and inactive (s3) segments is equal, in absolute value, to Vdd during the length of four additional pulses at each cycle. The mean voltage between the terminals of the active segment s1 is then 0.825 Vdd whilst the mean voltage at the terminals of the inactive segment s2 becomes 0.477 Vdd.

The second line of FIG. 6 illustrates an example of signal e2 capable of being applied to the electrode 111 to increase the transparent segment s3 and the opaque segment s4. The resulting voltage on the material of the segments s3 and s4 is not represented for the sake of concision, but can be obtained easily by subtracting e2-b1 resp. e2-b2.

The example illustrated in the figure corresponds to a display with two segments, controlled by multiplexed signals with a ratio N=2 (two back electrodes per segment). The inventive method can however be generalized to displays having more than two segments and to multiplexing rations N greater than 2. Furthermore, it is also possible to invert the role of the front and back electrodes and to use M front electrodes per segment.

The modifications performed on the control signals of the front and back electrodes are illustrated by way of example only. Other modifications of the shape, of the cycle ratio and/or of the phase of the signals applied can be conceived to modify the resulting voltage at the terminals of the active and/or inactive segments when the supply voltage increases and/or decreases.

In the preferred embodiment indicated here above, three different shapes of signals are used according to the value range in which the supply voltage Vdd lies. It is however also possible to provide a different number of value range for Vdd and a corresponding number of shapes of applied signals. For example, it is possible to modify the number of additional pulses added to the signals applied to the electrodes according to the variations of the supply voltage Vdd. In another embodiment, the width of the additional pulses added to increase or decrease the mean voltage depends on the value of the supply voltage Vdd. It is also possible to modify the width of these pulses in an analogous fashion, proportionally to the variation of Vdd.

In this case, the cycle ratio of the signal resulting on the segments is a discrete or continuous function of the supply voltage.

The value of the supply voltage Vdd can be determined by comparison with a reference value when such a valued is available. The reference value can for example be determined according to the threshold levels of one or several semiconductor elements, such as diodes or transistors. In one embodiment, the value of the threshold or thresholds from which the shape of the signals applied is modified depends on a set value determined by the user of the device, for example by means of a button or element for adjusting the display's contrast.

The shape of the signals applied can furthermore depend on other parameters, for example on the temperature determined by a temperature sensor, or on the surrounding luminosity determined by a photovoltaic sensor. These additional parameters can for example influence the supply voltage threshold values beyond which the shape of the supply signals is modified.

FIG. 7A illustrates an example of a circuit allowing ternary signals to be generated for controlling the back electrodes b1, b2 and front electrodes e1, e2. The signals b1, b2 on the back electrodes must be capable of taking up three logical levels, while the voltages corresponding to each level can vary with the supply voltage Vdd. In this example, the signals are generated with the aid of a microprocessor 5 having at least two exit terminals u and v capable of taking up one of the logical states 0, 1 or HiZ (high impedance exit). The logical state 1 corresponds to a voltage more or less equal to the supply voltage Vdd of the microprocessor 5. A network of impedances 50, arrayed in voltage divisor, allows the high impedance levels to be converted into intermediary levels depending on the ratios between the impedances, for example into 0.5 Vdd levels. The table of FIG. 7B indicates the voltages b1 and b2 obtained for different values of u and v.

The signals e1 and e2 for the front electrodes are purely binary and can be generated directly by the conventional digital exits of the microprocessor.

FIG. 8 illustrates a second example of circuit allowing ternary signals for controlling the back electrodes b1, b2 and binary signals for controlling the front electrodes e1, e2 to be generated. In this example, the signals are generated with the aid of a microprocessor 5 whose exit terminals u, v, w can only take up the logical states 0 or 1 (=Vdd), no reliable high impedance level being available.

In this case, the network of impedances 50' is more complex and the different desired combinations of b1 and b2 are generated from three binary signals u, v, w. The table of FIG. 8B indicates the logical states b1 and b2 obtained for different values of u, v and w.

The signals at the exit of the electrodes u, v, w, e1 and e2 in the examples of FIGS. 7 and 8 can be generated by a suitable program executed by the microprocessor 5 to generate binary sequences on the exit leads of the microprocessor 5.

The microprocessor described with reference to FIGS. 7 and 8 can be replaced by any other type of discrete or integrated logical circuit, for example an ASIC circuit, a FPGA, a ROM memory read sequentially, etc. It will be noted that the network of impedances 50 or 50' only serves to generate intermediary logical levels, in order to control the back electrodes with ternary signals; it however does not constitute a regulator and does not allow the voltage values corresponding to each logical state to be corrected.

The method and the circuit described can be generalized to a display having more than four segments. For example, a display with 32 segments (4 digits) can be controlled by means of four signals for controlling the back electrodes and 8 electrode signals, the multiplexing ratio in this example being four.

The method and the device described are notably advantageous as they allow to do without using a regulator for correcting the voltage applied to the segments. The invention however does not exclude using such a regulator, for example in the case of very considerable variations of the supply voltage that one wishes to compensate in different ways.

The invention claimed is:

1. A method for controlling a liquid crystal segment display, wherein alternating control signals are applied to said segment display so as to control opacity of the segment display, the method comprising determining a value of a supply voltage of a power source by comparison with a reference value, adapting using a logical circuit, the shape of at least certain of said signals according to the determined value of the supply voltage so as to compensate at least partially for variation in the supply voltage to provide a more uniform opacity of the segment display, the adapting comprising when the determined value of the supply voltage exceeds a determined threshold, adding further pulses to an alternating control signal applied to a front electrode and to an alternating control signal applied to a back electrode of inactive segments of the segment display so as to reduce the cycle ratio of a resulting voltage, and, when the determined value of the supply voltage goes below a second determined threshold, adding further pulses to an alternating control signal applied to a front electrode and to an alternating control signal applied to a back electrode of active segments of the segment display so as to increase the cycle ratio of the resulting voltage.

2. The method of claim 1, wherein the shape of said signals is adapted according to the supply voltage so as to compensate at least partially the variations of mean voltage applied to a segment.

3. The method of claim 1, wherein at least one said signal has a first shape when the value of the supply voltage is below a first threshold and a different shape when this value is above this first threshold.

4. The method of claim 3, wherein at least one signal has a first shape when said determined value of the supply voltage is below a first threshold, a second different shape when said determined value of the supply voltage is between the first threshold and a second threshold greater than the first threshold, and a third shape when said determined value of the supply voltage is greater than said second threshold.

5. The method of claim 3, wherein the value of said first threshold or the value of said second threshold is adjusted manually.

6. The method of claim 3, wherein the value of said first threshold or the value of said second threshold depends on the surrounding temperature and/or luminosity.

7. The method of claim 1, wherein each cycle for controlling each segment includes a first active phase, during which the voltage applied to the back electrode oscillates between two first values, and a second inactive phase, during which the voltage applied to the back electrode oscillates between two values lower in RMS value than said first values, where the opacity state of said segment depends mainly on the voltage applied to the front electrode of said segment during said first phase.

8. The method of claim 7, wherein the duration of said first phase is modified according to said supply voltage.

9. The method of claim 1, wherein the shape of said signals depends on the surrounding temperature and/or luminosity.

10. The method of claim 1, further comprising determining a value of the supply voltage by comparison with a reference value, and the step of adapting comprises adapting the shape of at least certain of said signals according to the determined value of the supply voltage.

11. A circuit for controlling a liquid crystal segment display, comprising a logical circuit for determining a value of a supply voltage of a power source by comparison with a reference value, generating alternating control signals capable of controlling the opacity of the segment display when applied to the segment display, and adapting the shape of said control signals based on the determined value of the supply voltage to compensate at least partially for variations in the supply voltage to provide a more uniform opacity of the segment display, the adapting comprising when the determined value of the supply voltage exceeds a determined threshold, adding further pulses to an alternating control signal applied to a front electrode and to an alternating control signal applied to a back electrode of inactive segments of the segment display so as to reduce the cycle ratio of a resulting voltage, and, when the determined value of the supply voltage goes below a second determined threshold, adding further pulses to an alternating control signal applied to a front electrode and to an alternating control signal applied to a back electrode of active segments of the segment display so as to increase the cycle ratio of the resulting voltage.

12. The circuit of claim 11, wherein said means include comparison means for determining if the supply voltage is above or below one or several thresholds, and means for adapting the shape of said signals according to the results of the comparison.

13. The circuit of claim 11, wherein said logical circuit is constituted by a programmable element for executing a program in order to generate said signals.

14. The circuit of claim 13, wherein said logical circuit includes a microprocessor comprising logical exits and at least one network of impedances for generating signals of intermediary levels from exit signals of said microprocessor.

15. A method for controlling a liquid crystal segment display, the method comprising: receiving at a logical circuit, a supply voltage from a power source; determining a value of the supply voltage by comparison with a reference value; and applying by the logical circuit, alternating control signals to the liquid crystal segment display to control an opacity of the liquid crystal segment display, wherein a shape of the control signals is based on the determined supply voltage value to compensate at least partially for variation in the received supply voltage and provide a more uniform opacity of the liquid crystal segment display, whereby when the determined value of the supply voltage exceeds a determined threshold, adding further pulses to an alternating control signal applied to a front electrode and to an alternating control signal applied to a back electrode of inactive segments of the liquid crystal segment display so as to reduce the cycle ratio of a resulting voltage, and, when the determined value of the supply voltage goes below a second determined threshold, adding further pulses to an alternating control signal applied to a front electrode and to an alternating control signal applied to a back electrode of active segments of the liquid crystal segment display so as to increase the cycle ratio of the resulting voltage.

* * * * *